US006311958B1

(12) United States Patent
Stanek

(10) Patent No.: US 6,311,958 B1
(45) Date of Patent: Nov. 6, 2001

(54) HUMIDIFIER WITH DETACHABLE FAN ASSEMBLY

(75) Inventor: Terrence L. Stanek, St. Charles, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/448,957

(22) Filed: Nov. 24, 1999

Related U.S. Application Data

(60) Provisional application No. 60/110,478, filed on Dec. 1, 1998, now abandoned.

(51) Int. Cl.[7] ..... B01F 3/04

(52) U.S. Cl. ..... 261/30; 261/84; 261/104; 261/107

(58) Field of Search ..... 261/30, 84, 99, 261/104, 107, DIG. 3, DIG. 41

(56) References Cited

U.S. PATENT DOCUMENTS

| | | | | |
|---|---|---|---|---|
| 1,784,907 | * | 12/1930 | Patrick | 261/30 |
| 1,786,200 | * | 12/1930 | Ferguson | 261/30 |
| 1,805,059 | * | 5/1931 | Wagenhals | 261/30 |
| 1,965,255 | * | 7/1934 | Peabody | 261/30 |
| 2,095,451 | * | 10/1937 | Reynolds | 261/30 |
| 2,653,017 | * | 9/1953 | Frost | 261/30 |
| 2,710,717 | * | 6/1955 | Palmer | 261/30 |

FOREIGN PATENT DOCUMENTS

| | | | | |
|---|---|---|---|---|
| 522420-A | * | 4/1931 | (DE) | 261/30 |
| 403273-A | * | 10/1909 | (FR) | 261/30 |
| 292656-A | * | 6/1928 | (GB) | 261/30 |
| 431357-A | * | 1/1933 | (GB) | 261/30 |
| 38609-A | * | 7/1936 | (NL) | 261/30 |

* cited by examiner

*Primary Examiner*—C. Scott Bushey
(74) *Attorney, Agent, or Firm*—Howrey Simon Arnold & White LLP

(57) ABSTRACT

A humidifier is disclosed. The humidifier includes a housing, in which a moisture source resides, and a fan assembly connected to the housing for moving dry air into the housing, through the water source, wherefrom the dry air picks up moisture, and finally out of the humidifier. The fan assembly is detachably connected to the housing and has a stand so that the fan assembly can be in an upright position when detached from the humidifier housing and function as a stand-alone fan. The humidifier housing has multiple openings for accommodating the power cord of the fan assembly. In operation, the fan assembly is attached to the humidifier housing to move air into the humidifier housing to pick up moisture from the source of water, and subsequently out of the humidifier housing to circulate humidified air; the fan assembly is then detached from the humidifier housing and operated to circulate unhumidified air. The power cord may be placed through any one of the multiple openings on the humidifier housing so that the humidifier may be positioned in a way that is the most space-saving, convenient and/or aesthetically pleasing.

8 Claims, 4 Drawing Sheets

HUMIDIFIER WITH DETACHABLE FAN ASSEMBLY

CROSS-REFERENCE TO RELATED APPLICATION

This application claims the benefit of U.S. Provisional Application No. 60/110,478, entitled "Humidifier With Detachable Fan Assembly," filed Dec. 1, 1998, by the same inventor, which is incorporated herein by reference in its entirety.

BACKGROUND OF THE INVENTION

1. Field of the Invention

This invention relates to humidifiers and, more specifically, to a humidifier with a detachable fan assembly.

2. Description of the Related Art

Stand-alone electric fans are commonly used in homes for air circulation and are a popular appliance for alleviating heat in hot weather. They are commercially sold in many varieties, including table-top, window-mount and floor models. Humidifiers are commonly used in homes to add moisture to the air, particularly during the winter months, when the moisture content in air may be uncomfortably low. A humidifier typically includes a moisture source, such as a wick in partial contact with water in a reservoir, for supplying moisture to dry air. A humidifier may further include one or more fans as an integral component for moving dry air through the water source and supplying moist air into the home. In many areas, during the course of a year, there are both periods during which the use of a humidifier is desirable and those during which the use of a stand-alone fan is desirable. As a result, consumers in those areas often need to purchase both appliances but use each only part of the year. Such seasonal use of multiple appliance is less economical than using a single appliance and creates extra need for storage space.

The present invention addresses these and other shortcomings associated with prior art.

SUMMARY OF THE INVENTION

The present invention is a humidifier which includes a fan assembly that is detachable from the other components of the humidifier and is operable as a stand-alone fan.

In one embodiment, the humidifier includes a frame such as a humidifier housing, a moisture source and a detachable fan assembly. The humidifier housing defines an opening above which fan assembly may be positioned when functioning as a component of the humidifier. The detachable fan assembly of the humidifier has protective grilles both in front of and behind the fan blades, making the fan assembly safe to use as a stand-alone fan. The fan assembly also includes a base portion functioning as a stand, which allows the fan assembly to be in an upright position when operating as a stand-alone fan. Three slots are defined on the humidifier housing for accommodating the power cord for the fan assembly so that the user can choose the location of the power cord exit so as to position the humidifier in a way that is the most space saving, convenient and/or aesthetically pleasing.

In another embodiment, the detachable fan assembly unit has a pivotally attached elongated base plate that may be rotated about the pivot axis to be aligned with the direction of air flow through the fan assembly to increase the stability of the fan assembly when the fan assembly is used as a stand-alone fan.

BRIEF DESCRIPTION OF THE DRAWINGS

Other objects and advantages of the invention will become apparent upon reading the following detailed description and upon reference to the drawings in which.

Figure 1A:
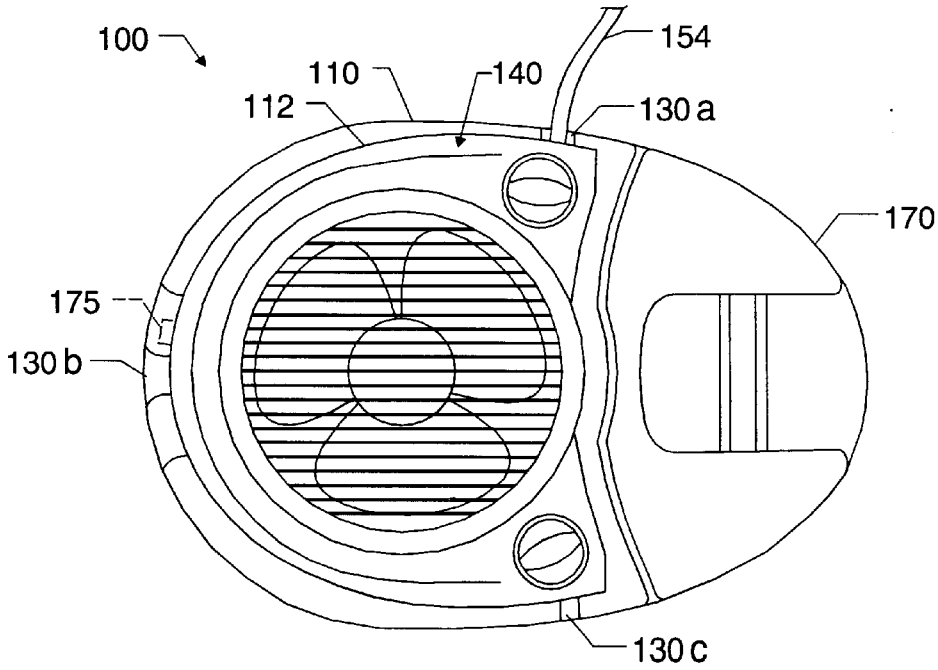
FIG. 1A shows the top view of a first embodiment of the present invention.
Figure 1B:
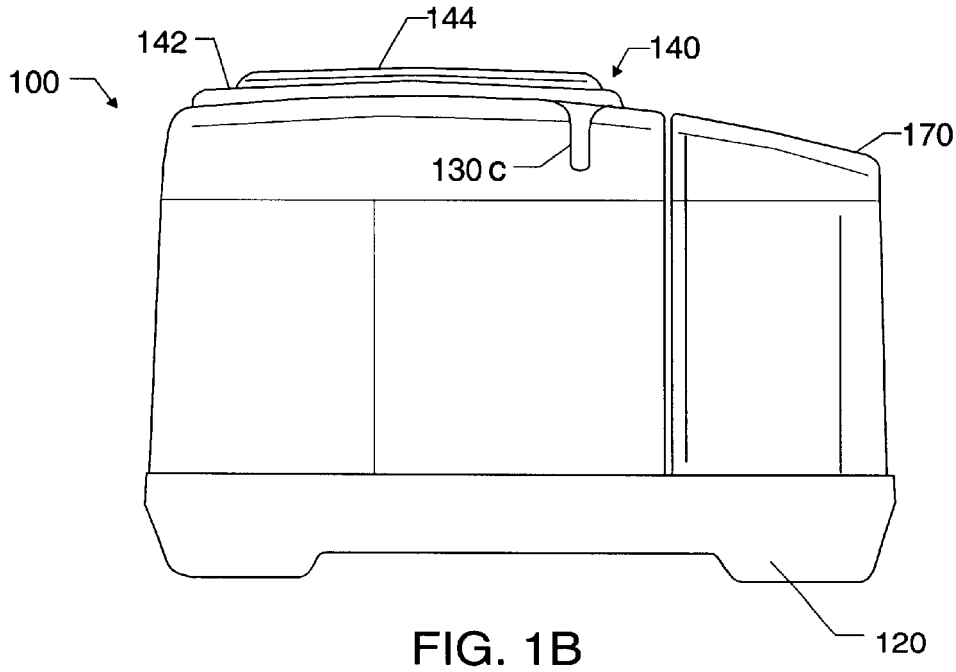
FIG. 1B shows the front view of the first embodiment of the present invention.
Figure 1C:
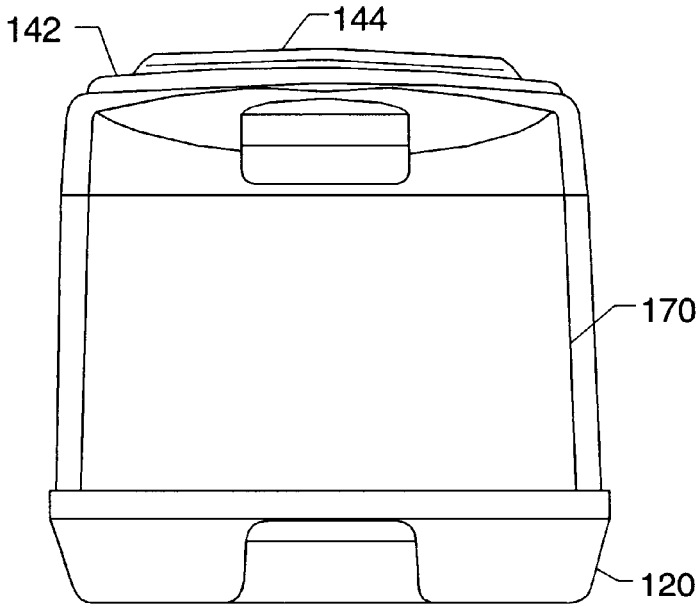
FIG. 1C shows the side view of the first embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment. numerous implementation-specific decisions must be made to achieve the developers' specific goals, such as compliance with system-related and business-related constraints, which will vary from one implementation to another. Moreover, it will be appreciated that such a development effort might be complex and time-consuming, but would nonetheless be a routine undertaking for those of ordinary skill in the art having the benefit of this disclosure.

As a first embodiment of the present invention, illustrated in FIGS. 1A–1F, a humidifier 100 includes a frame such as a humidifier housing 110, a detachable fan assembly 140 and a water bottle 170. The water bottle 170 is supported at the bottom by the base portion 120 of the humidifier housing 110 and supplies water to the moisture source 160, connected to the humidifier housing 110. The moisture source 160 may be a wick system, which employs one or more wettable wicks for supplying moisture to dry air. The fan assembly 140 includes a fan housing 142 and a fan blade assembly 148 inside the fan housing 142. The fan housing 142 includes a front protective grille 144 and a back protective grille 146 in front of and behind, respectively, the fan blade assembly 148 for protecting the fan blade assembly 148 while permitting airflow through the fan assembly 148. A power cord 154 emanates from the back side of the fan assembly 140.

Figure 1D:
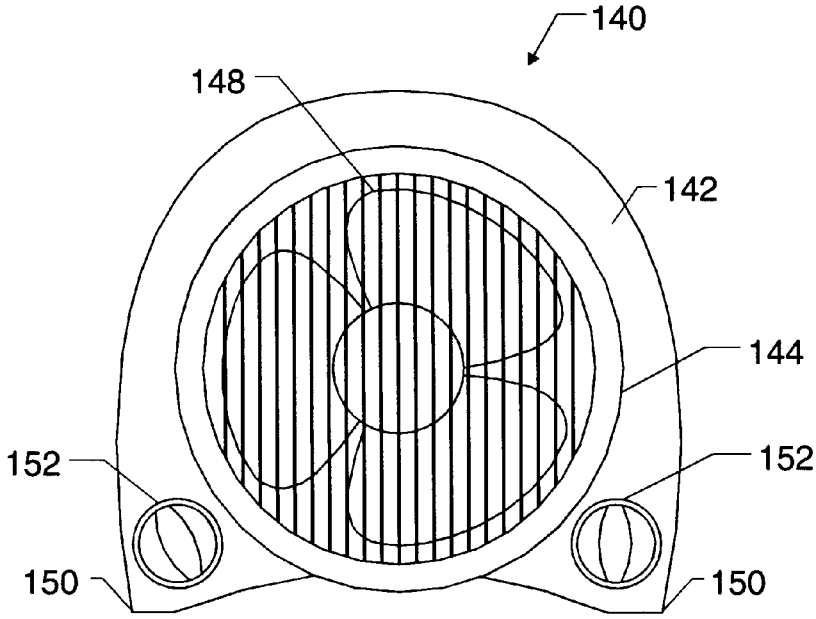
FIG. 1D shows the front view of fan assembly of the first embodiment of the present invention in stand-alone mode.
Figure 1E:
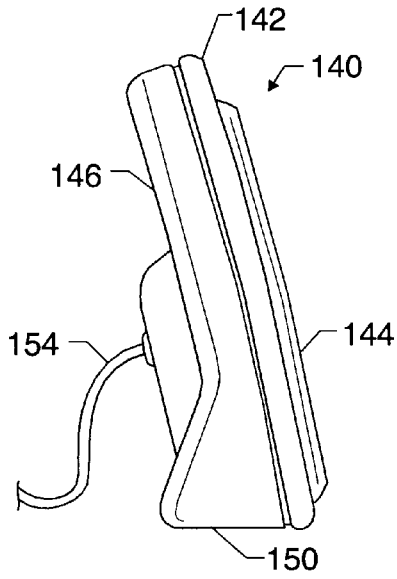
FIG. 1E shows the side view of fan assembly of the first embodiment of the present invention in stand-alone mode.

The fan assembly 140 functions as a stand-alone unit when detached from the humidifier housing 110, as illustrated in FIGS. 1D and 1E. The base portion 150 of the fan assembly 140 acts as a stand and defines a plane so that the fan assembly 140 can remain in an stable, upright position on a flat surface when operating in the stand-alone mode.

Figure 1F:
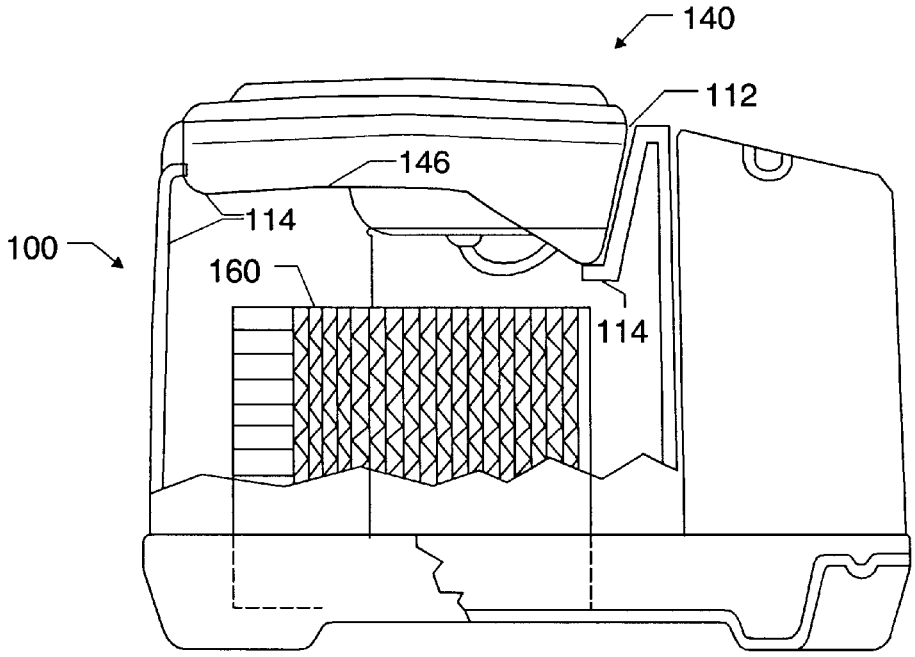
FIG. 1F shows a partially cut-away side view of the first embodiment of the present invention, showing the placement of the fan assembly in the humidifier and the moisture source.

The fan assembly 140 may also be attached to the humidifier housing 110 and function as a component of the humidifier 100 for moving air through the humidifier 100. The humidifier housing 110 forms a depression 112, the shape of which conforms to that of the fan assembly 140, for receiving the fan assembly 140. The bottom of the depression 112 defines an opening 114. The fan assembly 140 is simply placed in the depression 112, facing upwards, so that the back protective grille 146 is juxtaposed with the opening 114, as shown in FIG. 1F.

Three openings, such as slots 130A, 130B and 130C are defined on the humidifier housing 110 to accommodate the power cord 154 when the fan assembly 140 is placed in the depression 112. The power cord 154 may be routed through any of the slots 130A, 130B and 130C so that the humidifier 100 may be positioned in a way that is the most space-saving, convenient and/or aesthetically pleasing.

Figure 2:
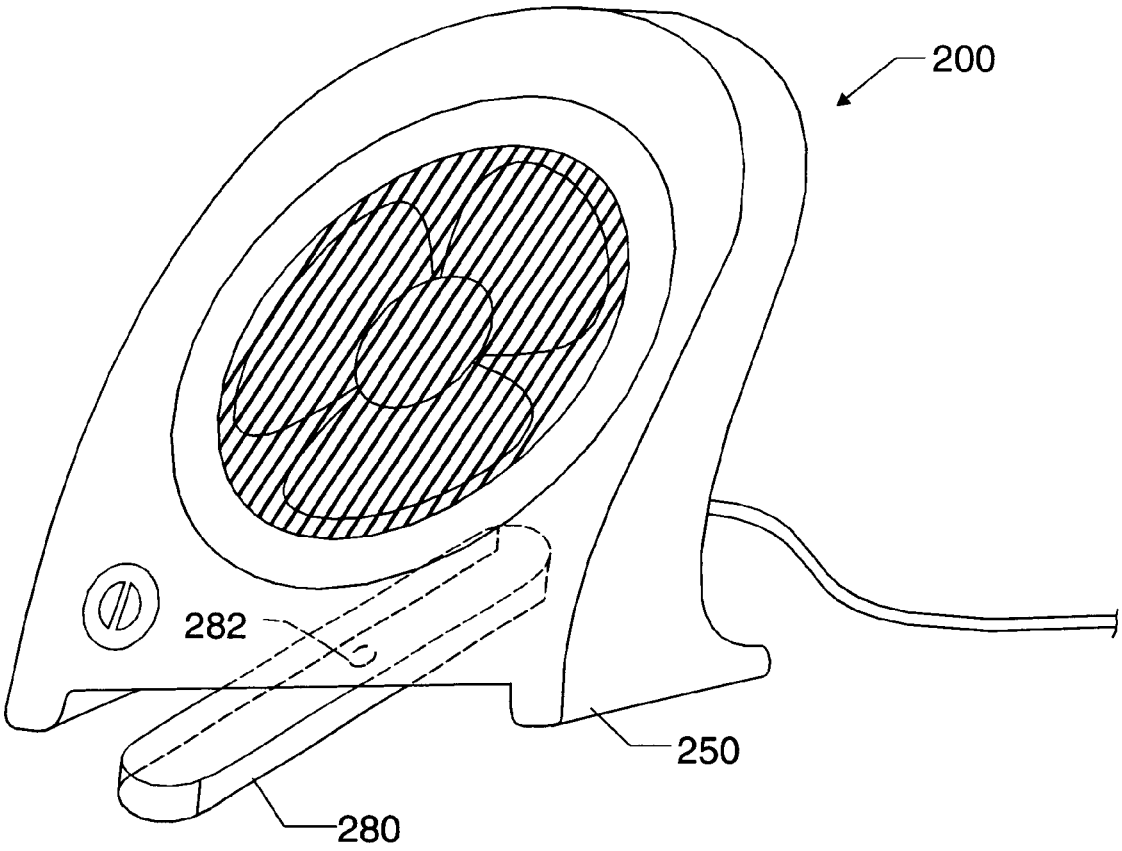
FIG. 2 shows a fan assembly with a stabilizer plate rotated out when the fan assembly operates in stand-alone mode.

In a second embodiment of the present invention, as shown in FIG. 2, the detachable fan assembly 200 is otherwise similar to the fan assembly 100 in the first embodiment but further includes an elongated base plate 280, which acts as a stabilizer, pivotally attached to the base 250 of the fan assembly 200 at a pivot point 282. When the fan assembly 200 is connected to the humidifier housing, the base plate is rotated so that it is hidden under the base portion 250. When the fan assembly 200 is used as a stand-alone fan, the base plate 280 may be rotated about the pivot point 282 so that the long axis of the base plate is substantially aligned with the direction of air flow through the fan assembly 200, thereby increasing the stability of the fan assembly 200 as a stand-alone fan.

Instead of, or in addition to, the depression for holding the fan assembly in the above embodiments, the humidifiers may farther include fasteners 175 such as thumbscrews and buckles for attaching the fan assembly to the humidifier housing, as shown in FIG. 1A. The fan assembly may also include multiple rotating blade assemblies and may be of a window-mount type.

In operating the humidifier of the above embodiments, the fan assembly is attached to the humidifier housing and operated to move air into the humidifier housing, through the moisture source to pick up moisture, and subsequently out of the humidifier housing to circulate humidified air. The fan assembly is then detached from the humidifier housing and operated to circulate unhumidified air.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A humidifier, comprising:

a frame;

a moisture source connected to said frame; and a fan assembly detachably connected to said frame and adapted to move an air stream to be wetted by said moisture source, said fan assembly comprising:

fan blade assembly having a front side and a back side;

a front protective grille in front of the front side of said blade assembly;

a back protective grille behind the back side of said blade assembly;

a base having a bottom portion defining a plane, whereby said fan assembly can remain free-standing in a stable, upright position on a flat surface when said fan assembly is detached from aid frame; and a power cord wherein said frame defines a plurality of slots her accommodating said power cord.

2. The humidifier as set forth in claim 1, wherein said frame defines a depression for receiving said fan assembly, said fan assembly being positioned at least partially disposed within said depression.

3. The humidifier as set forth in claim 1, wherein said moisture source is a wettable wick.

4. The humidifier en set forth in claim 2, wherein said moisture source is a wettable wick.

5. The humidifier as set forth in claim 2, further comprising a fastener for securing said fan assembly to said frame.

6. The humidifier as set forth in claim 1, wherein said base of said fan assembly comprises a stabilizer that is positionable between first and second position, relative to said fan assembly, said stabilizer being located in said first position when said fan assembly is connected to said humidifier housing, and in said second position when said fan assembly is detached from said humidifier housing.

7. A method of circulating air with a humidifier comprising a frame defining a plurality of slots therein, a moisture source connected to said frame and a fan assembly detachably mounted on said frame, said fan assembly having a power cord attached thereto and comprising a base having a bottom portion defining a plane, whereby said fan assembly can remain free-standing in a stable, upright position on a flat surface when said assembly is detached from said frame, said method comprising the steps of:

attaching said fan assembly to said frame;

positioning said power cord in one of the plurality of slots defined by the frame;

operating said fan assembly so as to move air through said moisture source to pick up moisture from said moisture source, and subsequently out of the humidifier to circulate humidified air;

detaching said fan assembly from said housing;

standing said fan assembly on its base in an upright position; and operating said fan assembly detached from said housing to circulate unhumidified air.

8. A humidifier, comprising:

a frame;

a moisture source connected to said frame; and a fan assembly detachably connected to said frame and adapted to move an air stream to be wetted by said moisture source, said fan assembly comprising:

a fan blade assembly having a front side and a back side;

a front protective grille in front of the front side of said blade assembly;

a back protective grille behind the back side of said blade assembly; and a base having a bottom portion defining a plane, said base of said fan assembly comprises a stabilizer that is positionable between first and second positions relative to said fan assembly, said stabilizer being located in said first position when said fan assembly is connected to said humidifier housing, and in said second position when said fan assembly is detached from said humidifier housing, wherein said stabilizer being in said second position increases the stability of the fan assembly while in a free-standing upright position.

* * * * *

UNITED STATES PATENT AND TRADEMARK OFFICE

CERTIFICATE OF CORRECTION

PATENT NO. : 6,311,958 B1
DATED : November 6, 2001
INVENTOR(S) : Terrence L. Stanek It is certified that error appears in the above-identified patent and that said Letters Patent is hereby corrected as shown below:

Column 4,
Line 19, delete "her" and insert -- for --.
Line 26, delete "en" and insert -- as --.
Line 32, after "between" insert -- a --.
Line 44, after "first occurrence of "said" insert -- fan --.

Signed and Sealed this

Sixth Day of August, 2002

*Attest:*

*Attesting Officer*

JAMES E. ROGAN
*Director of the United States Patent and Trademark Office*